US010914154B2

(12) United States Patent
Reid et al.

(10) Patent No.: US 10,914,154 B2
(45) Date of Patent: Feb. 9, 2021

(54) POWER SEQUENCING FOR PUMPING SYSTEMS

(71) Applicant: Halliburton Energy Services, Inc., Houston, TX (US)

(72) Inventors: John Carl Reid, Duncan, OK (US); Alexander Simon Chretien, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 19 days.

(21) Appl. No.: 16/347,398

(22) PCT Filed: Dec. 7, 2016

(86) PCT No.: PCT/US2016/065343
§ 371 (c)(1),
(2) Date: May 3, 2019

(87) PCT Pub. No.: WO2018/106225
PCT Pub. Date: Jun. 14, 2018

(65) Prior Publication Data

US 2020/0263525 A1 Aug. 20, 2020

(51) Int. Cl.
*E21B 43/26* (2006.01)
*F04B 15/02* (2006.01)
(Continued)

(52) U.S. Cl.
CPC ..... *E21B 43/26* (2013.01); *F04B 15/02* (2013.01); *F04B 23/04* (2013.01); *F04B 49/02* (2013.01);
(Continued)

(58) Field of Classification Search
CPC ..... F04D 13/10; F04D 13/12; F04D 15/029; F04D 15/0066; F04B 23/04; F04B 49/06; F04B 15/02; F04B 49/02; F05D 2270/335
See application file for complete search history.

(56) References Cited

U.S. PATENT DOCUMENTS 5,253,982 A * 10/1993 Niemiec ..... F04B 11/0008 417/371
5,422,550 A * 6/1995 McClanahan ..... H02P 5/50 318/103
(Continued)

FOREIGN PATENT DOCUMENTS

WO WO-9509981 A1 * 4/1995 ..... F04D 15/0236

OTHER PUBLICATIONS

International Search Report and Written Opinion issued in related PCT Application No. PCT/US2016/065343 dated Aug. 23, 2017, 16 pages.

*Primary Examiner* — James G Sayre
(74) *Attorney, Agent, or Firm* — John W. Wustenberg; Baker Botts L.L.P.

(57) ABSTRACT

A pumping system pumps material or fluid, for example, downhole to perform a stimulation operation. A pumping system may comprise multiple pumps that must be powered-up in a sequence that does not overload a power source. A variable frequency drive may be coupled to a pump via a motor and may adjust the speed of the motor to control the rate of pumping of fluid from the pump. A soft-starter may be coupled to a pump via a motor to provide a constant pumping rate of fluid from the pump. A power-up sequence may be determined that provides power to the variable frequency pump and the soft-starter to power-up the corresponding motors such that the power source is not strained or overloaded. Mixing variable frequency drive driven pumps with pumps driven by a soft-starter may provide an
(Continued)

efficient use of available power, conserve space, allow for control over a pumping rate of fluid and reduce costs.

20 Claims, 5 Drawing Sheets

(51) Int. Cl.

| | |
|---|---|
| ***F04B 23/04*** | (2006.01) |
| ***F04B 49/02*** | (2006.01) |
| ***F04B 49/06*** | (2006.01) |
| ***F04D 13/10*** | (2006.01) |
| ***F04D 13/12*** | (2006.01) |
| ***F04D 15/00*** | (2006.01) |
| ***F04D 15/02*** | (2006.01) |

(52) U.S. Cl.
CPC ..... *F04B 49/06* (2013.01); *F04D 13/10* (2013.01); *F04D 13/12* (2013.01); *F04D 15/0066* (2013.01); *F04D 15/029* (2013.01); *F05D 2270/335* (2013.01)

(56) References Cited

U.S. PATENT DOCUMENTS

| | | | | |
|---|---|---|---|---|
| 7,508,160 | B1 * | 3/2009 | Rudniski | H02P 1/426 318/801 |
| 2014/0174717 | A1 | 6/2014 | Broussard et al. | |
| 2014/0203640 | A1 | 7/2014 | Stinessen | |
| 2016/0006379 | A1 * | 1/2016 | Wang | H02P 5/74 318/5 |
| 2016/0032703 | A1 * | 2/2016 | Broussard | E21B 43/26 166/250.01 |
| 2016/0208592 | A1 * | 7/2016 | Oehring | F04D 29/669 |
| 2016/0258267 | A1 | 9/2016 | Payne et al. | |
| 2017/0030177 | A1 * | 2/2017 | Oehring | E21B 7/026 |
| 2017/0051732 | A1 * | 2/2017 | Hemandez | F04B 17/03 |
| 2018/0156210 | A1 * | 6/2018 | Oehring | F01D 15/10 |

* cited by examiner

POWER SEQUENCING FOR PUMPING SYSTEMS

CROSS-REFERENCE TO RELATED APPLICATION

The present application is a U.S. National Stage Application of International Application No. PCT/US2016/065343 filed Dec. 7, 2016, which is incorporated herein by reference in its entirety for all purposes.

TECHNICAL FIELDS

The present disclosure relates generally to pumping systems, and more specifically (although not necessarily exclusively), to efficient power sequencing for pumping systems.

BACKGROUND

In general, stimulation or fracturing pumping trailers included a variable frequency drive to drive a primary electric motor for a pumping system. Variable frequency drives are typically expensive and of considerable weight and size. Variable frequency drives may also consume more power than other types of starters. Additionally, a given operation may not require a variable pumping rate for each pump. Thus, the use of variable frequency drives may not provide the most efficient use of resources.

DETAILED DESCRIPTION

Figure 1:
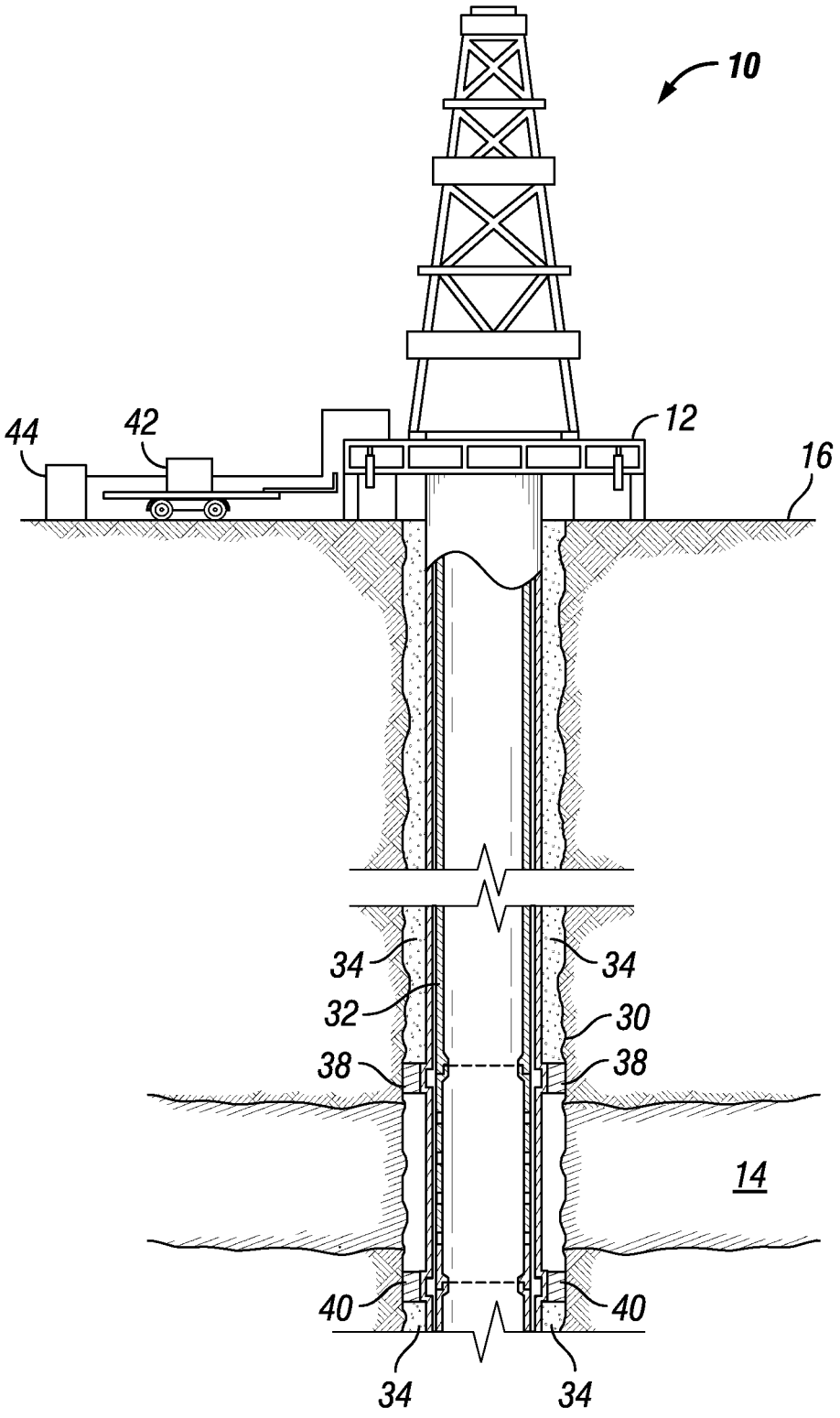
FIG. 1 is a schematic diagram of an apparatus for transferring material in a wellbore.

Certain aspects and features of the present disclosure relate to an efficient or optimized power-up sequence for one or more motors of a pumping system. Variable frequency drives may be used to power-up a motor coupled to a pump. Variable frequency drives are typically expensive, bulky, and heavy and may have higher power consumption rates than other starters. Soft-starters, in contrast, are smaller and less expensive and may consume less power than variable frequency drives. While a given operation may require that pumping rates be altered during the operation, providing a combination of variable frequency drives and soft-starters provides for a power efficient and cost efficient configuration for a pumping system. The power source may be controlled by a control system to allocate power to a select number of variable frequency drives that power-up one or more pumps while the power-up of additional pumps is performed by soft-starters. Once all of the motors associated with the pumps of a pumping system are powered-up or at the required operating speed, the speed of the motors associated with the variable frequency drives may be adjusted to accommodate a required pumping rate while the motors associated with the soft-starters may be maintained at a constant speed. Thus, resources are conserved as variable frequency drives are only coupled to those pumps requiring adjustable pumping rates.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory.

Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. The information handling system may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

FIG. 1 is a schematic diagram of an apparatus 10 for transferring material in a wellbore 30. Generally, apparatus 10 illustrates a system for transferring material from a surface-located hydrocarbon well site 12. The well site 12 is located over a hydrocarbon bearing formation 14, which is located below a ground surface 16. While well site 12 is illustrated at a ground surface 16, the present disclosure contemplates any one or more embodiments implemented at a well site at any location, including, at sea above a subsea hydrocarbon bearing formation.

The wellbore 30 is formed through various earth strata including the formation 14. A pipe or casing 32 is insertable into the wellbore 30 and may be cemented within the wellbore 30 by cement 34. A centralizer/packer device 38 may be located in the annulus between the wellbore 30 and the casing 32 just above the formation 14, and a centralizer packer device 40 is located in the annulus between the wellbore 30 and the casing 32 just below the formation 14. A pumping system 42 according to one or more aspects of the present disclosure is located at the well site 12. The pumping system 42 may be configured to transfer material including but not limited to, water, gel (for example, linear gel, cross-linked gel, Zanthan based gel or any other gel), breaker, friction reducer, surfactant, biocide, sand, proppant, diverter, acid, PH control fluid, gases (for example, nitrogen, natural gas, carbon dioxide, a fracking or stimulation fluid or any combination thereof. The pumping system 42 may be controlled by a control system 44 located at the well site 12 (as illustrated). In one or more embodiments, control system 44 may be located remote from the well site 12. In one or more embodiments, control system 44 may comprise one or more information handling systems, such as the information handling system 200 described with respect to FIG. 2.

Figure 2:
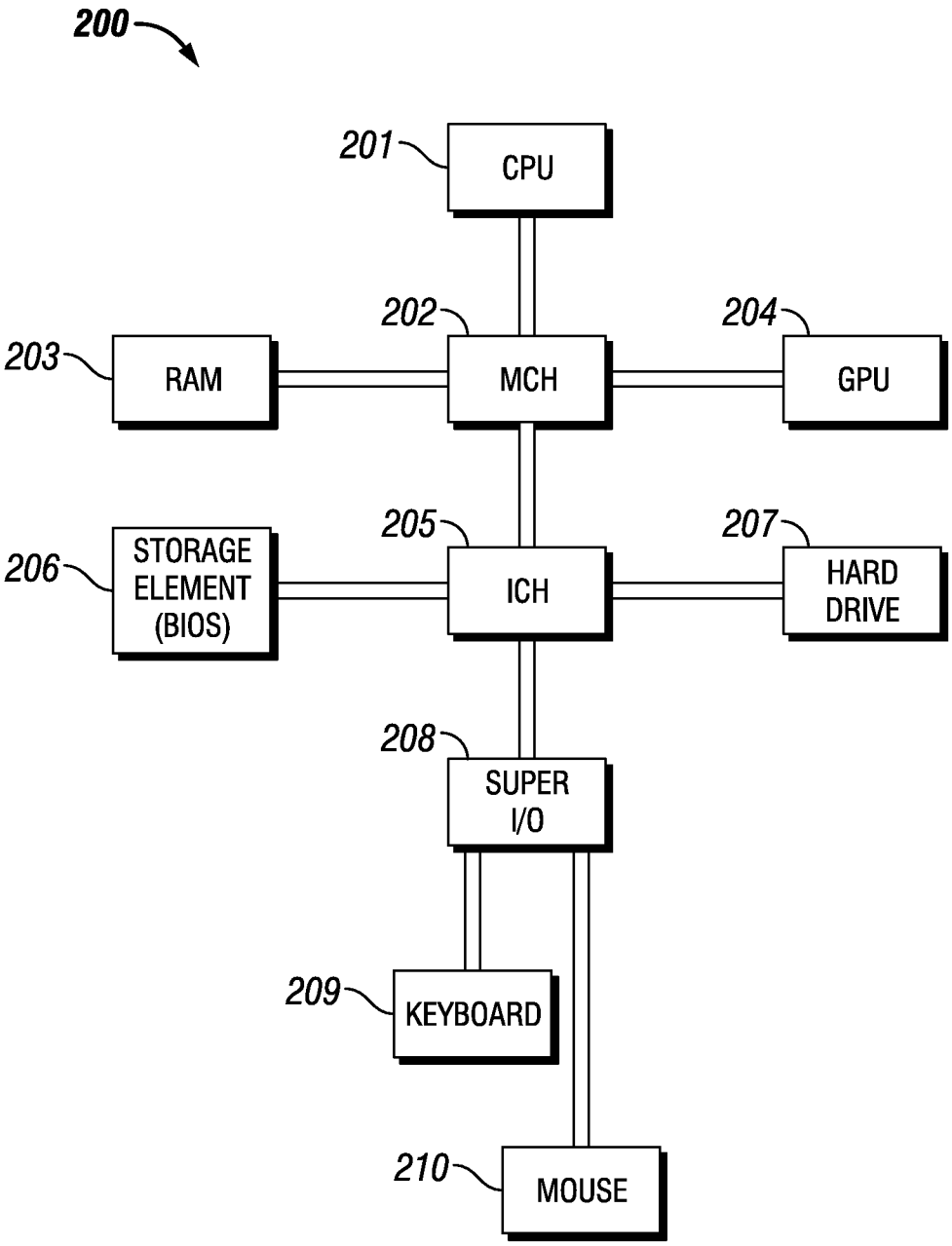
FIG. 2 is a diagram illustrating an example information handling system, according to aspects of the present disclosure.

FIG. 2 is a diagram illustrating an example information handling system 200, according to aspects of the present disclosure. The control system 44 may take a form similar to the information handling system 200 or include one or more components of information handling system 200. A processor or central processing unit (CPU) 201 of the information handling system 200 is communicatively coupled to a memory controller hub (MCH) or north bridge 202. The processor 201 may include, for example a microprocessor, microcontroller, digital signal processor (DSP), application specific integrated circuit (ASIC), or any other digital or analog circuitry configured to interpret and/or execute program instructions and/or process data. Processor 201 may be configured to interpret and/or execute program instructions or other data retrieved and stored in any memory such as memory 203 or hard drive 207. Program instructions or other data may constitute portions of a software or application for carrying out one or more methods described herein. Memory 203 may include read-only memory (ROM), random access memory (RAM), solid state memory, or disk-based memory. Each memory module may include any system, device or apparatus configured to retain program instructions and/or data for a period of time (for example, computer-readable non-transitory media). For example, instructions from a software or application may be retrieved and stored in memory 203 for execution by processor 201.

Modifications, additions, or omissions may be made to FIG. 2 without departing from the scope of the present disclosure. For example, FIG. 2 shows a particular configuration of components of information handling system 200. However, any suitable configurations of components may be used. For example, components of information handling system 200 may be implemented either as physical or logical components. Furthermore, in some embodiments, functionality associated with components of information handling system 200 may be implemented in special purpose circuits or components. In other embodiments, functionality associated with components of information handling system 200 may be implemented in configurable general purpose circuit or components. For example, components of information handling system 200 may be implemented by configured computer program instructions.

Memory controller hub 202 may include a memory controller for directing information to or from various system memory components within the information handling system 200, such as memory 203, storage element 206, and hard drive 207. The memory controller hub 202 may be coupled to memory 203 and a graphics processing unit (GPU) 204. Memory controller hub 202 may also be coupled to an I/O controller hub (ICH) or south bridge 205. I/O controller hub 205 is coupled to storage elements of the information handling system 200, including a storage element 206, which may comprise a flash ROM that includes a basic input/output system (BIOS) of the computer system. I/O controller hub 205 is also coupled to the hard drive 207 of the information handling system 200. I/O controller hub 205 may also be coupled to a Super I/O chip 208, which is itself coupled to several of the I/O ports of the computer system, including keyboard 209 and mouse 210.

In certain embodiments, the control system 44 may comprise an information handling system 200 with at least a processor and a memory device coupled to the processor that contains a set of instructions that when executed cause the processor to perform certain actions. In any embodiment, the information handling system may include a non-transitory computer readable medium that stores one or more instructions where the one or more instructions when executed cause the processor to perform certain actions. As used herein, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a computer terminal, a network storage device, or any other suitable device and may vary in size, shape, performance, functionality, and price. The information handling system may include random access memory (RAM), one or more processing resources such as a central processing unit (CPU) or hardware or software control logic, read only memory (ROM), and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

Figure 3:
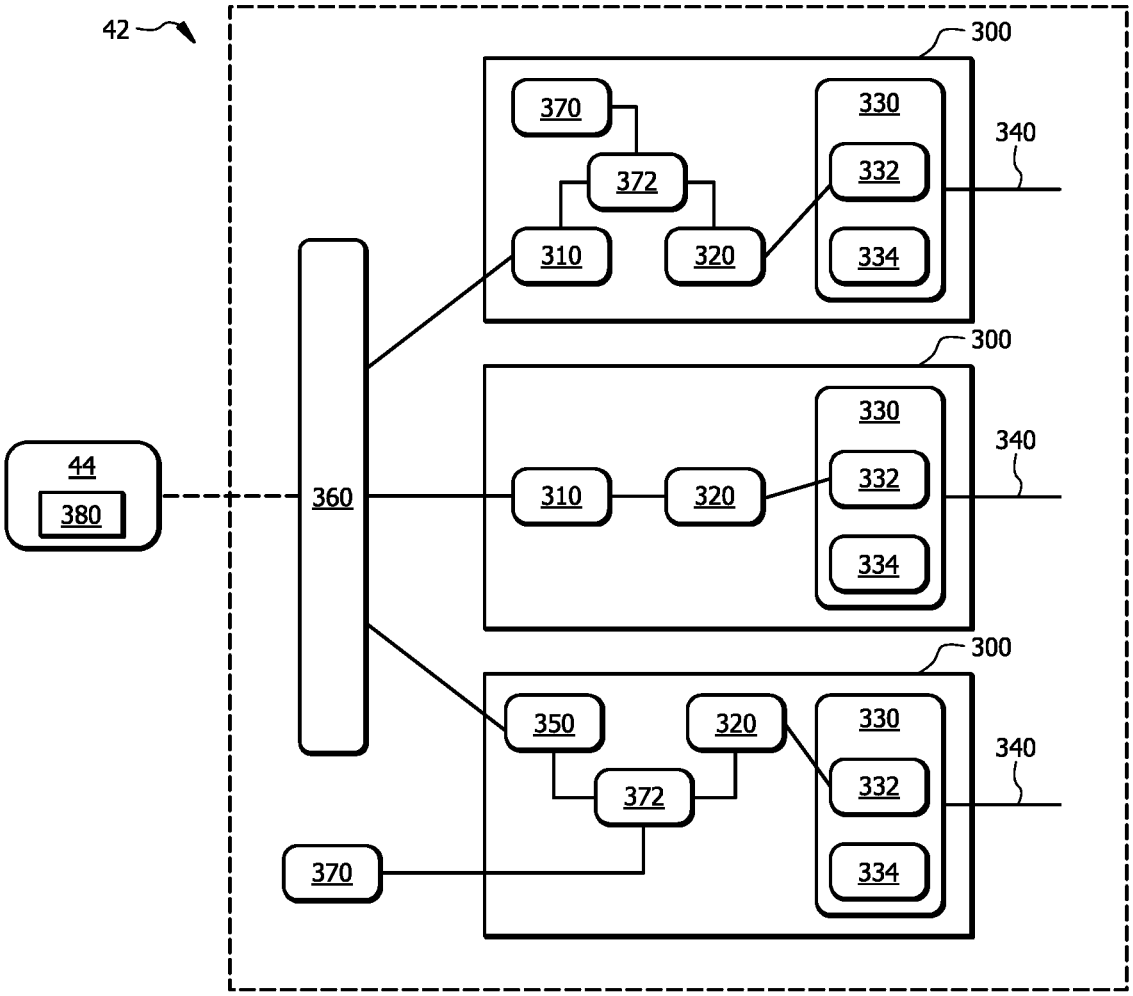
FIG. 3 is a schematic diagram of a pumping system for pumping materials or fluids, according to one or more aspects of the present disclosure.

FIG. 3 is a schematic diagram of a pumping system 42 for pumping a fluid or material 334, for example downhole in wellbore 30 of FIG. 1, according to one or more aspects of the present disclosure. In one or more embodiments, a pumping system 42 comprises a power grid 360, one or more soft-starters 310, a variable frequency drive 350, one or more motors 320, one or more hydraulic pumping systems 330, and a flow line 340. Any one or more components of the pumping system 42 may be located on the surface 16 or a support structure 300. A support structure 300 may comprise any one or more of a truck, a trailer, a barrel, a tank, a skid, a vessel, a railcar, any other vehicle or any other suitable location. The power grid 360 provides a source of power to start or power-up the one or more motors 320 of the one or more hydraulic pumping systems 330. In one or more embodiments, the power grid 360 may comprise one or more different types of power sources including but not limited to an electric motor, a turbine engine or any other type of power source.

Hydraulic pumping system 330 may comprise one or more hydraulic pumps 332 for pumping a fluid 334 out flow line 340. In one or more embodiments, a pumping system 330 may comprise any number or quantity and any type of hydraulic pumps 332. For example, in one or more embodiments, any number of variable displacement hydraulic pumps 332 may pump fluid 334. A hydraulic pump 332 may comprise any suitable type of hydraulic pump 332 including, but not limited to, a positive displacement hydraulic pump and a variable displacement hydraulic pump (for example, axial piston pump or bent axis pump). In one or more embodiments, fluid 334 may be pumped by the hydraulic pumps 332 from any fluid source. The fluid 334 may be disposed on the support structure 300 or at the surface 16, a truck, a trailer, a barrel, a tank, or any other location or vehicle, a vessel, a railcar, or any other suitable device for storing fluid or any combination thereof. In one or more embodiments, fluid or material 334 to be pumped downhole by any one or more pumping systems may comprise cement, slurry, water, air, linear gel, cross-linked gel, break, friction reducer surfactant, biocide, sand, proppant, diverter or any other fracking or stimulation fluid.

The one or more motors 320 may comprise any type of motor or engine including, but not limited to, an electric motor. The type of motor 320 may depend on one or more factors including, but not limited to, any one or more of the efficiency of operation of the power grid 360, the required speed, torque level, power capacity, and pressure required by any one or more of the hydraulic pumping systems 330, weight, size or power density of the motor 320, and cost of any component of the motor 320.

Power from the power grid 360 may be transferred to or used to provide power to a variable frequency drive 350 and one or more soft-starters 310. As a variable frequency drive 350 may be expensive or require a larger footprint than a soft-start 310, a variable frequency drive 350 may be used to power-up one or more hydraulic pumping systems 330 while a soft-starter 310 may be used to power-up one a hydraulic pumping system 330. The variable frequency drive 350 may be coupled to a motor 320 to provide power to the motor 320. The motor 320 may be coupled to a hydraulic pump 332. The variable frequency drive 350 may be used to vary the rate of speed of the motor 320 to adjust the pumping of fluid 334 out flow line 340 from the hydraulic pump 332.

A soft-starter 310 may be coupled to a motor 320 to provide power to the motor 320. The soft-starter 310 may maintain a constant power source to the motor 320 such that the motor 320 provides a constant speed to a coupled hydraulic pump 332. In one or more embodiments, a switch 362 may be disposed or positioned between the motor 320 and a power source for the motor 320, for example, soft-starter 310 and constant power source 370. For example, once the motor 320 is powered-up by the soft-starter 310, the motor 320 may be switched to constant power source 370 via switch 372. In one or more embodiments, control system 44 may communicate a control signal to the switch 372 to cause the switch 372 to trigger or activate to switch or transfer the power source for the motor 320 from a soft-starter 310 to a constant power source 370. In one or more embodiments, switch 372 may automatically trigger or activate automatically based, at least in part, on one or more characteristics of the soft-starter 310, the motor 320 or both. In one or more embodiments, the switch 362 may trigger or activate to switch or transfer the power source for motor 320 based, at least in part, on a threshold power, voltage or current level. For example, the switch 372 may trigger or activate when the soft-starter 310, motor 320, or both has reached a predetermined power, voltage or current level such that a threshold level has been reached or surpassed. In one or more embodiments, control system 44 may monitor the power, current or voltage level of the soft-starter 310, the motor 320 or both to determine completion, success or failure of a power-up sequence for motor 320. In one or more embodiments, any one or more of constant power source 370 and switch 372 may be positioned or disposed on support structure 300 or any other suitable location.

The soft-starter 310 (or other constant power source 360) may maintain the motor 320 at a constant speed such that fluid 334 pumped from hydraulic pump 332 out flow line 340 is pumped at a constant rate. In one or more embodiments, the fluid 334 pumped from any one or more hydraulic pumping systems 330 out flow lines 340 may be the same type of fluid. In one or more embodiments, the fluid 334 pumped from any one or more hydraulic pumping systems 330 may be one or more different types of fluid. For example, a first hydraulic pumping system 330 may pump a first type fluid 334 while a second hydraulic pumping system 330 may pump a second type of fluid 334.

In one or more embodiments, a control system 44 may be coupled to the power grid 360. Control system 44 may comprise one or more information handling systems 200 of FIG. 2 or one or more methods may be performed manually. Control system 44 may be communicatively coupled directly or indirectly, via a wire or wirelessly, or by any other communication system or combination thereof to the power grid 360. Control system 44 may comprise a software program comprising one or more executable instructions or controller to control output of power from the power grid 360 to one or more of the variable frequency drives 350 and the soft-starter 310. For example, software program or controller 380 of control system 44 may transmit a power control signal to power grid 360. The power control signal may cause the power grid 360 to provide power to one or more of variable frequency drives 350 or soft-starter 310. For example, the power grid 360 may be commanded or instructed by control system 44 to power-up one or more variable frequency drives 350. The power-up of the one or more variable frequency drives 350 may strain or overload the power grid 360 (or require an amount of power such that the power grid 360 cannot provide power to any other components) such that no other power sources (such as one or more other variable frequency drives 350 or one or more soft-starters 310) may be powered-up. Once the one or more variable frequency drives 350 are powered-up, the software program or controller 380 may transmit a power control signal to power grid 360 to provide power to one or more other variable frequency drives 350, one or more other soft-starters 310 or any combination thereof may.

While FIG. 3 illustrates three support structures 300 with a single support structure 300 comprising one variable frequency drive 350 and two other or additional trailers 300 each comprising one or more soft-starters 310, the present disclosure contemplates any number of support structures 300 with any number of soft-starters 310 or variable frequency drives 350. For example, in one or more embodiments, a first set of three support structures 300 may each comprise a variable frequency drive 350 while a second set of six support structures 300 may each comprise a soft-starter 310. In one or more embodiments, the first set of support structure 300 may provide variable speed control for one or more hydraulic pumps 332 from 0 rotations per minute (rpm) to 1600 rpm and the second set of support structures 300 may provide a constant speed for one or more hydraulic pumps 332 of 1600 rpm. A job or operation that requires, for example, 54 barrels (3,240 cubic meters per minute) per minute of fluid to be pumped downhole may receive 9.5 barrels per minute (or 570 cubic meters per minute) of fluid from the second set of trailers with the variable frequency drives 350 of the first set of trailers may be adjusted to drive the corresponding motors 320 to cause the hydraulic pumps 332 to pump fluid at rate to meet the remaining required barrels (or cubic meters) per minute.

Figure 4:
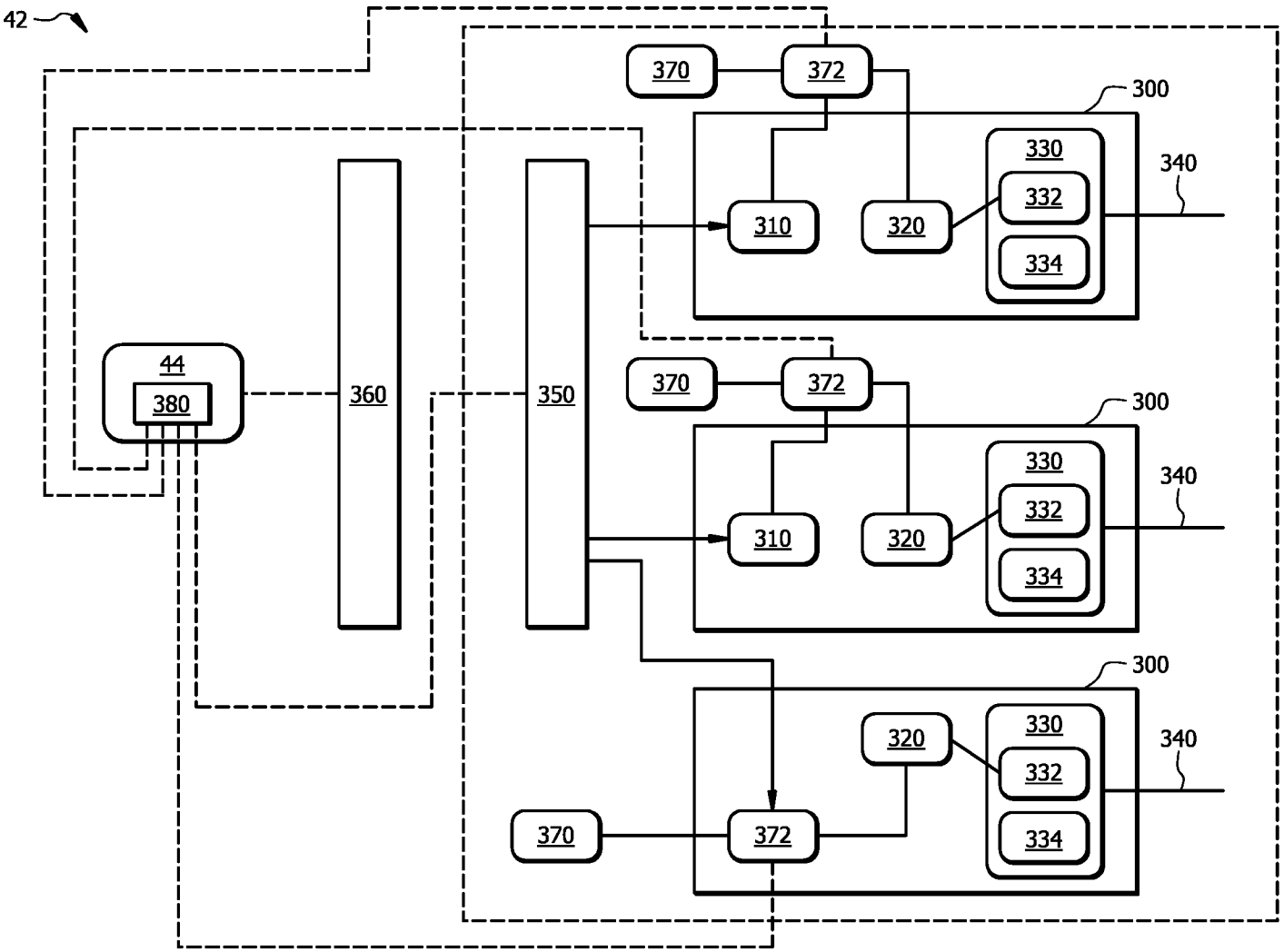
FIG. 4 is a schematic diagram of a pumping system for pumping materials or fluids, according to one or more aspects of the present disclosure.

FIG. 4 is a schematic diagram of a pumping system 42 for pumping a fluid or material 334, for example downhole in wellbore 30 of FIG. 1, according to one or more aspects of the present disclosure. FIG. 4 is similar to FIG. 3 except that a variable frequency drive 350 may be coupled initially to one or more switches 372 and one or more soft-starters 310. Once a motor 320 or soft-starter 310 is powered-up the motor 320 or soft-starter 310 may be switched or transferred to a constant power source 370. For example, a control signal from software program or controller 380 may cause switch 372 to switch a motor 320 to a constant power source 370. In one or more embodiments, the variable frequency drive 350 may be coupled to a first set of devices including, but not limited to, one or more soft-starters 310, one or more switches 372, or any combination thereof. The variable frequency drive 350 may be switched or transferred to a second set of devices including, but not limited to, any one or more other one or more soft-starters 310, one or more motors 320 or any combination thereof after power-up and may remain coupled to one or more motors 320 after power-up of the first set of devices. In one or more embodiments, the variable frequency drive 350 may be directly coupled to a motor 320 and may remain coupled to a motor 320 throughout an operation such that the speed of the motor 320 may be adjusted to provide variable pumping rates of fluid 334 pumped out flow lines 340 by one or more hydraulic pumps 332 of one or more hydraulic pumping systems 330.

A control system 44 via a software program or controller 380 may control the switching of the variable frequency drive 350 to any one or more soft-starters 310, motors 320 or any combination thereof. Control system 44 via a software program or controller 380 may cause the variable frequency drive 350 to adjust the rate of speed of any correspondingly coupled motor 320 to adjust the pumping rate of a hydraulic pump 332.

Figure 5:
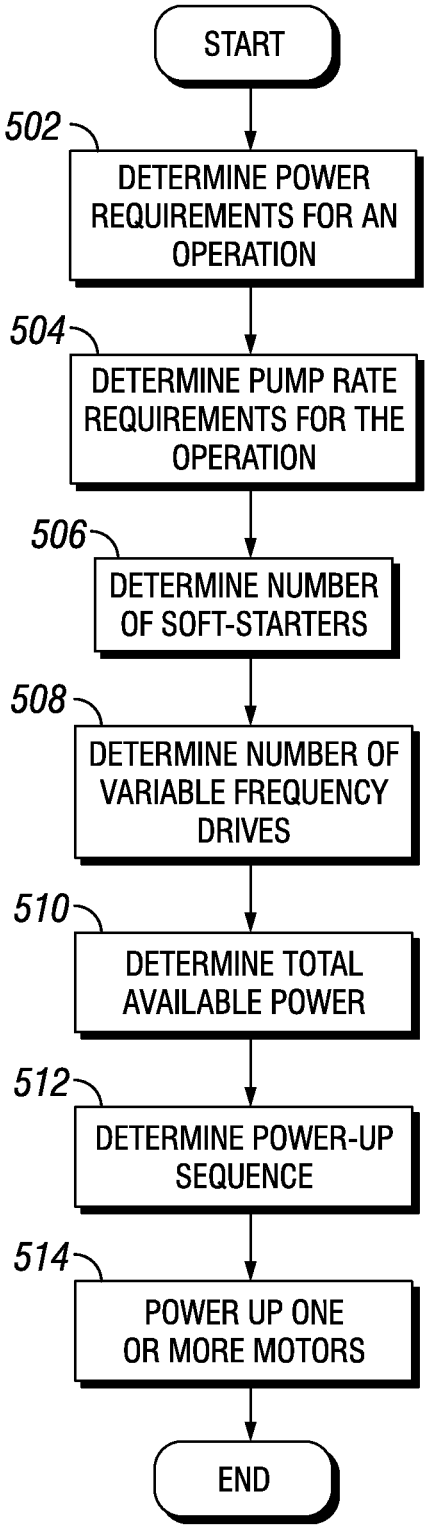
FIG. 5 is a flowchart for a method for configuring and powering a pumping system, according to one or more aspects of the present disclosure.

FIG. 5 is a flowchart for a method for configuring and powering a pumping system, for example, pumping system 42 of FIG. 3 and FIG. 4, according to one or more aspects of the present disclosure. At step 502, the power requirements for a given operation or job, for example, a pumping operation, at a location or site are determined. For example, a power grid (for example, power grid 360 of FIG. 3) may be required to provide power to one or more pumping systems 42 and one or more other site devices. At step 504, the pump rate required for the operation or job is determined. For example, for a given operation a predetermined pump rate may be required to adequately perform the operation. At step 506, the number or quantity of soft-starters (for example, soft-starter 310 of FIG. 3 and FIG. 4) and at step 508, the number or quantity of variable frequency drives (for example, variable frequency drive 350 of FIG. 3 and FIG. 4) available or required for a given operation or job are determined. At step 510, the total available power at the site or location is determined.

At step 512, the power-up sequence for site equipment or one or more devices such as one or more pumps (for example, hydraulic pumps 332 of FIG. 3 and FIG. 4) is determined. The power-up sequence may be based, at least in part, on the total available power of the power grid 360, the required power to power-up any one or more motors 320, the time required to power-up any one or more motors 320, priority of a given device is required (for example, one or more hydraulic pumps 332 of FIG. 3 and FIG. 4 may have a higher priority than one or more other hydraulic pumps 332 or one or more other devices), any one or more other factors or combination thereof.

At step 514, the one or more motors are powered-up based, at least in part, on the power-up sequence. In one or more embodiments a software program or controller (for example software program or controller 380 of FIG. 3 and FIG. 4) of a control system (for example, control system 44 of FIG. 3 and FIG. 4) may control or implement the power-up sequence. For example, a control system 44 determine the total available power of power grid 360 and transmit a control signal to power grid 360 to provide power to a first variable frequency drive 350, a soft-starter 310, or any combination thereof to power-up a corresponding motor 320. In one or more embodiments, the power requirements for providing power to a first variable frequency drive 350 for powering-up a corresponding motor 320 may strain or overload the power grid 360 such that no other soft-starter 310 or variable frequency drive 350 may be provided power until the first variable frequency drive has powered-up the motor 320. In one or more embodiments, one or more variable frequency drives 350 and one or more soft-starters are provided power from the power grid 360 on a rolling basis. For example, the power grid 360 may have a total available power to power a first set of one or more devices at a given time, such as, one or more variable frequency drives 350, one or more soft-starters 310 or any combination thereof. The power grid 360 may be commanded or instructed by control system 44 to provide power to additional devices as power becomes available, for example, once any of the first set of one or more devices has powered-up corresponding motors 320. For example, control system 44 may determine the available power of power grid 360 and based, at least in part, on the available power may instruct power grid 360 to initially provide power to a first variable frequency drive 350 and a second variable frequency drive 350. The first variable frequency drive 350 may power-up a corresponding motor 320 and as such power grid 360 may have power available for other devices. The control system 44 may then determine power grid 360 has sufficient power to power one or more soft-starters 310, one or more other variable frequency drives 350 or any combination thereof.

In one or more embodiments, motor 320 may couple to a switch 372. Switch 372 couples the motor 320 to either a direct power source line 370 or a variable frequency drive 350. In one or more embodiments, the control system 44 may communicate (for example, transmit a control signal) to a switch 372 to transfer the motor 320 to a direct power source line 370. The variable frequency drive 350 may then be transferred, connected or coupled to a different device. For example, a first control signal may be transmitted by the control system 44 to the switch 372 to cause the variable frequency drive 350 to be decoupled from a motor 320 and a second control signal may be transmitted to the switching system 380 to cause the variable frequency drive 350 to couple or connect to one or more soft-starters 310. In one or more embodiments, switching system 380 and switch 372 may be the same device, for example, a multiplexer or multi-switch device. In one or more embodiments, the same control signal may decouple the variable frequency device 350 from the motor 320 and couple the variable frequency device 350 to one or more soft-starters 310. In one or more embodiments, variable frequency device 350 may power-up a plurality of soft-starters 310 or a single soft-starter 310 based, at least in part, on the total available power and the one or more power requirements of the one or more soft-starters 310. The control system 44 may cause the variable frequency drive 320 to continuously decouple from a soft-starter 310 once the soft-starter 310 has powered-up a motor 320 and to couple to another soft-starter 310 until all motors 320 have been power-up.

In one or more embodiments, a pumping system comprises a control system coupled to a power grid, a soft-starter coupled to the power grid, a first motor coupled to the first variable frequency drive, a first pump coupled to the first motor, wherein the first pump pumps a first fluid at a constant rate, a variable frequency drive coupled to a second motor and a second pump coupled to the second motor wherein the second pump pumps a second fluid at a variable rate and wherein the control system provides a power control signal to the power grid to control power to the soft-starter and the variable frequency drive. In one or more embodiments, at least one of the soft-starter, the first motor, and the first hydraulic pump and the variable frequency drive, the second motor and the second pump are disposed on a trailer. In one or more embodiments, the pumping system further comprises a second soft-starter coupled to the power grid, a third motor coupled to the second soft-starter and a third pump coupled to the third motor. In one or more embodiments, the soft-starter is powered-up after the variable frequency drive is powered-up. In one or more embodiments, the soft-starter is coupled to the power grid via the variable frequency drive. In one or more embodiments, the pumping system further comprises a constant power source coupled to the soft-starter via a switch, wherein the motor is coupled to the soft-starter via the switch and wherein the switch transfers the motor to the constant power source when a threshold has been reached. In one or more embodiments, the pumping system further comprises a fluid flow line coupled to the first pump and the second pump to transfer the first fluid and the second fluid downhole.

In one or more embodiments, a method for pumping a fluid comprises providing power from a power source to a variable frequency drive to power-up a first motor based, at least in part, on a power-up sequence, wherein the first motor drives a first pump, providing power from the power source to a soft-starter to power-up a second motor based, at least in part, on the power-up sequence, wherein the second motor drives a second pump, pumping the fluid from the first pump at a variable pump rate and the second pump at a constant pump rate and wherein the power-up sequence is based, at least in part, on a total available power and one or more power requirements of the first motor and the second motor. In one or more embodiments, the method for pumping the fluid further comprises assigning a priority to each of the first pump and the second pump and wherein the power-up sequence is based, at least in part, on the assigned priority. In one or more embodiments, the power-up sequence requires that the variable frequency drive is powered-up prior to the soft-starter. In one or more embodiments, the method for pumping the fluid further comprises decoupling the variable frequency drive from the first motor and coupling the variable frequency drive to a second soft-starter. In one or more embodiments, the total available power is based on available power from a power grid coupled to the variable frequency drive and the soft-starter. In one or more embodiments, the method for pumping the fluid further comprises activating a switch coupled to the second motor to transfer to a constant power source for the second motor.

In one or more embodiments, a system for providing power to a plurality of pumps comprises a power grid, a variable frequency drive coupled to the power grid, a first motor coupled to the variable frequency drive, wherein the first motor drives a first pump of the plurality of pumps, a soft-starter coupled to the power grid, a second motor coupled to the soft-starter, wherein the second motor drives a second pump of the plurality of pumps and an information handling system coupled to the power grid, wherein the information handling system comprises a processor and non-transitory storage medium, the non-transitory storage medium comprising one or more instructions that, when executed by the processor, cause the processor to transmit a first control power signal to the power grid to provide power to the variable frequency drive to power-up the first motor, wherein the first control power signal is based, at least in part, on a power-up sequence, transmit a second control power signal to the power grid to provide power to the soft-starter to power-up the second motor, wherein the second control power signal is based, at least in part, on the power-up sequence and wherein the power-up sequence is based, at least in part, on a total available power and one or more power requirements of the first motor and the second motor. In one or more embodiments, the one or more instructions that, when executed by the processor, further cause the processor to assign a priority to each of the first pump and the second pump and wherein the power-up sequence is based, at least in part, on the assigned priority. In one or more embodiments, the power-up sequence requires that the variable frequency drive is powered-up prior to the soft-starter. In one or more embodiments, the one or more instructions that, when executed by the processor, further cause the processor to transmit a control signal to transfer the variable frequency drive from the first motor to a second soft-starter. In one or more embodiments, the one or more instructions that, when executed by the processor, further cause the processor to transmit a second control signal to connect a direct power source line to the first motor. In one or more embodiments, the total available power is based on available power from a power grid coupled to the variable frequency drive and the soft-starter. In one or more embodiments, the one or more instructions that, when executed by the processor, further cause the processor to activate a switch coupled to the second motor to transfer source of power to the second motor from the power grid to a constant power source.

The foregoing description of certain aspects, including illustrated aspects, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A pumping system comprising:

a control system coupled to a power grid;

a soft-starter coupled to the power grid;

a first motor coupled to the soft starter;

a first pump coupled to the first motor, wherein the first pump pumps a first fluid at a constant rate;

a variable frequency drive coupled to a second motor; and a second pump coupled to the second motor, wherein the second pump pumps a second fluid at a variable rate;

wherein the control system provides a power control signal to the power grid to control power to the soft-starter and the variable frequency drive; and determining, based on a total available power of the power grid and power requirements of the soft starter and the variable frequency drive to power-up the respective first and second motors, that the power grid can power-up only one of the first motor and the second motor at one time;

wherein:

the control system controls the power grid to provide power to one of the soft starter and the variable frequency drive to power-up a respective first motor or second motor; and when one of the first motor and the second motor has powered up, the control system controls the power grid to provide power to the remaining one of the soft starter and the variable frequency drive to power-up the remaining one of the respective first motor and the second motor.

2. The pumping system of claim 1, wherein at least one of the soft-starter, the first motor, and the first hydraulic pump and the variable frequency drive, the second motor and the second pump are disposed on a trailer.

3. The pumping system of claim 1, further comprising:

a second soft-starter coupled to the power grid;

a third motor coupled to the second soft-starter; and a third pump coupled to the third motor.

4. The pumping system of claim 1, wherein the soft-starter is powered-up after the variable frequency drive is powered-up.

5. The pumping system of claim 1, wherein the soft-starter is coupled to the power grid via the variable frequency drive.

6. The pumping system of claim 1, further comprising:

a constant power source coupled to the soft-starter via a switch, wherein the first motor is coupled to the soft-starter via the switch; and wherein the switch transfers the first motor to the constant power source when a threshold has been reached.

7. The pumping system of claim 1, further comprising a fluid flow line coupled to the first pump and the second pump to transfer the first fluid and the second fluid downhole.

8. A method for pumping a fluid, comprising:

providing power from a power source to a variable frequency drive to power-up a first motor based, at least in part, on a power-up sequence, wherein the first motor drives a first pump;

providing power from the power source to a soft-starter to power-up a second motor based, at least in part, on the power-up sequence, wherein the second motor drives a second pump;

pumping the fluid from the first pump at a variable pump rate and the second pump at a constant pump rate;

wherein the power-up sequence is based, at least in part, on a total available power and one or more power requirements of the first motor and the second motor; and determining, based on the total available power and power requirements of the variable frequency drive and the soft starter to power-up the respective first and second motors, that the total available power can power-up only one of the first motor and the second motor at one time;

wherein the power-up sequence includes:

providing power to one of the variable frequency drive and the soft starter to power-up a respective first motor or second motor; and when one of the first motor and the second motor has powered-up, providing power to the remaining one of the variable frequency drive and the soft starter to power-up the remaining one of the respective first motor and the second motor.

9. A method for pumping the fluid of claim 8, further comprising:

assigning a priority to each of the first pump and the second pump; and wherein the power-up sequence is based, at least in part, on the assigned priority.

10. The method for pumping the fluid of claim 8, wherein the power-up sequence requires that the variable frequency drive is powered-up prior to the soft-starter.

11. The method for pumping the fluid of claim 8, further comprising:

decoupling the variable frequency drive from the first motor; and coupling the variable frequency drive to a second soft-starter.

12. The method for pumping the fluid of claim 8, wherein the total available power is based on available power from a power grid coupled to the variable frequency drive and the soft-starter.

13. The method for pumping the fluid of claim 8, further comprising activating a switch coupled to the second motor to transfer to a constant power source for the second motor.

14. A system for providing power to a plurality of pumps, comprising:

a power grid;

a variable frequency drive coupled to the power grid;

a first motor coupled to the variable frequency drive, wherein the first motor drives a first pump of the plurality of pumps;

a soft-starter coupled to the power grid;

a second motor coupled to the soft-starter, wherein the second motor drives a second pump of the plurality of pumps; and an information handling system coupled to the power grid, wherein the information handling system comprises a processor and non-transitory storage medium, the non-transitory storage medium comprising one or more instructions that, when executed by the processor, cause the processor to:

transmit a first control power signal to the power grid to provide power to the variable frequency drive to power-up the first motor, wherein the first control power signal is based, at least in part, on a power-up sequence;

transmit a second control power signal to the power grid to provide power to the soft-starter to power-up the second motor, wherein the second control power signal is based, at least in part, on the power-up sequence;

wherein the power-up sequence is based, at least in part, on a total available power of the power grid and one or more power requirements of the first motor and the second motor; and determine, based on the total available power of the power grid and power requirements of the variable frequency drive and the soft starter to power-up the respective first and second motors, that the power grid can power-up only one of the first motor and the second motor at one time;

wherein the power-up sequence includes:

providing power to one of the variable frequency drive and the soft starter to power-up a respective first motor or second motor; and when one of the first motor and the second motor has powered-up, providing power to the remaining one of the variable frequency drive and the soft starter to power-up the remaining one of the respective first motor and the second motor.

15. The system of claim 14, wherein the one or more instructions that, when executed by the processor, further cause the processor to:

assign a priority to each of the first pump and the second pump; and wherein the power-up sequence is based, at least in part, on the assigned priority.

16. The system of claim 14, wherein the power-up sequence requires that the variable frequency drive is powered-up prior to the soft-starter.

17. The system of claim 14, wherein the one or more instructions that, when executed by the processor, further cause the processor to transmit a control signal to transfer the variable frequency drive from the first motor to a second soft-starter.

18. The system of claim 17, wherein the one or more instructions that, when executed by the processor, further cause the processor to transmit a second control signal to connect a direct power source line to the first motor.

19. The system of claim 14, wherein the total available power is based on available power from a power grid coupled to the variable frequency drive and the soft-starter.

20. The system of claim 14, wherein the one or more instructions that, when executed by the processor, further cause the processor to activate a switch coupled to the second motor to transfer source of power to the second motor from the power grid to a constant power source.

* * * * *